US007792465B2

(12) United States Patent
Kubo et al.

(10) Patent No.: US 7,792,465 B2
(45) Date of Patent: Sep. 7, 2010

(54) DEVELOPING DEVICE, PROCESS CARTRIDGE, AND IMAGE FORMING APPARATUS

(75) Inventors: Tatsuya Kubo, Tokyo (JP); Yoshitaka Fujinuma, Tokyo (JP); Susumu Tateyama, Tokyo (JP); Masayoshi Nakayama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 160 days.

(21) Appl. No.: 12/031,141

(22) Filed: Feb. 14, 2008

(65) Prior Publication Data

US 2008/0199205 A1 Aug. 21, 2008

(30) Foreign Application Priority Data

Feb. 20, 2007 (JP) ..... 2007-038888
Mar. 30, 2007 (JP) ..... 2007-090168

(51) Int. Cl.
*G03G 15/08* (2006.01)

(52) U.S. Cl. ..... 399/254

(58) Field of Classification Search ..... 399/254, 399/107, 110, 113, 119, 256, 260, 269, 279
See application file for complete search history.

(56) References Cited

U.S. PATENT DOCUMENTS

2006/0029421 A1* 2/2006 Ishii et al. ..... 399/111
2007/0274742 A1 11/2007 Nakayama et al.
2007/0280744 A1 12/2007 Kubo et al.
2009/0028612 A1* 1/2009 Fujimori ..... 399/279

FOREIGN PATENT DOCUMENTS

JP 2001-249545 9/2001
JP 2004-85879 3/2004

OTHER PUBLICATIONS

Machine translation of Miyasaka et al. (JP 2001-249545, Listed in IDS).*
Machine translation of Kobayashi et al. (JP 2004-085879, Listed in IDS).*
U.S. Appl. No. 12/060,606, filed Apr. 1, 2008, Nakayama, et al.
U.S. Appl. No. 12/251,580, filed Oct. 15, 2008, Nakayama et al.

* cited by examiner

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

A disclosed developing device is for accommodating a developer including carriers and a toner, and for developing a latent image formed on an image carrier. The developing device includes plural developer conveying units configured to convey the developer accommodated in the developing device and form circulating paths; and a ventilation unit configured to perform ventilation between at least one of the developer conveying units whose internal pressure increases and at least one of the developer conveying units whose internal pressure decreases.

14 Claims, 7 Drawing Sheets

DEVELOPING DEVICE, PROCESS CARTRIDGE, AND IMAGE FORMING APPARATUS

BACKGROUND OF THE INVENTION

1. Field of the Invention

The present invention relates generally to image forming apparatuses employing an electrophotographic method, such as copiers, printers, facsimile machines, or a multifunction peripheral including these functions, and also to developing devices and process cartridges that are provided in such image forming apparatuses. More particularly, the present invention relates to a developing device, a process cartridge, and an image forming apparatus including plural developer conveying units forming circulating paths for the developer.

2. Description of the Related Art

Conventionally, there is known an image forming apparatus such as a copier or a printer provided with a developing device accommodating a two-component developer (in which an additive may be added) including a toner and carriers. Plural developer conveying units are provided in the developing device for performing a developing procedure by circulating the developer in a lengthwise direction (see, for example, patent document 1).

More specifically, the developing device includes a first developer conveying unit (a conveying unit provided with a first screw auger), a second developer conveying unit (a conveying unit provided with a second screw auger), and a third developer conveying unit (a conveying unit provided with a third screw auger). The first developer conveying unit faces a developer carrier (developing magnet roller), and supplies the developer to the developer carrier while conveying the developer in a lengthwise direction (in a direction of a rotation axis of the developer carrier). The second developer conveying unit is disposed at a position that is underneath the first developer conveying unit and that faces the developer carrier, and conveys, in a lengthwise direction, the developer that has separated from the developer carrier. The third developer conveying unit conveys the developer conveyed by the second developer conveying unit to an upstream side of the first developer conveying unit, and conveys the developer that has reached the downstream side of the first developer conveying unit to an upstream side of the first developer conveying unit.

That is, the first developer conveying unit has a function of supplying the developer to the developer carrier, the second developer conveying unit has a function of collecting the developer from the developer carrier, and the third developer conveying unit has a function of forming a circulating path to the upstream side of the first developer conveying unit.

In such a developing device, circulating paths are formed in the lengthwise direction, and therefore the developer does not become uneven along the lengthwise direction. Accordingly, the developer can be efficiently and sufficiently mixed and stirred, and the size of the device in the widthwise direction (a direction orthogonal to the lengthwise direction) can be relatively small. Particularly, the developer in the device can flow smoothly by providing the first developer conveying unit for supplying the developer and the second developer conveying unit for collecting the developer, which are facing the developer carrier.

Patent Document 1: Japanese Laid-Open Patent Application No. 2001-249545

The problem with the developing device disclosed in patent document 1 is that the toner scatters outside the developing device and soils the inside of the image forming apparatus, and the scattered toner soils the output image. Particularly, a significant amount of toner scatters from the second developer conveying unit for collecting the developer that has separated from the developer carrier.

This is because the plural developer conveying units are partitioned by walls, and the internal pressure changes.

Specifically, in the second developer conveying unit, a suction airflow is generated as the developer carrier rotates, and the internal pressure becomes higher than the external pressure (positive pressure). Accordingly, the toner floating inside the second developer conveying unit is blown out from gaps of the device (for example, from gaps at both edges of the developer carrier in the lengthwise direction) and scatters outside.

Furthermore, in the first developer conveying unit, a blow-out airflow is generated as the developer carrier rotates, and the internal pressure becomes lower than the external pressure (negative pressure). Accordingly, the efficiency of passing the developer from the first developer conveying unit to other developer conveying unit decreases, and redundant toner scatters outside the device.

The above phenomena are particularly significant in a high-speed machine in which the developer carrier and conveying members provided in the developer conveying units revolve at high rotational speeds.

SUMMARY OF THE INVENTION

The present invention provides a developing device, a process cartridge, and an image forming apparatus in which one or more of the above-described disadvantages are eliminated.

A preferred embodiment of the present invention provides a developing device, a process cartridge, and an image forming apparatus in which the amount of scattered toner is small even when plural developer conveying units are provided.

An embodiment of the present invention provides a developing device for accommodating a developer including carriers and a toner, and for developing a latent image formed on an image carrier, the developing device including plural developer conveying units configured to convey the developer accommodated in the developing device, and form circulating paths; and a ventilation unit configured to perform ventilation between at least one of the developer conveying units whose internal pressure increases and at least one of the developer conveying units whose internal pressure decreases.

According to one embodiment of the present invention, a developing device, a process cartridge, and an image forming apparatus are provided, in which the amount of scattered toner is small even when plural developer conveying units are provided, because a ventilation unit is provided for performing ventilation between a developer conveying unit whose internal pressure increases and a developer conveying unit whose internal pressure decreases.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention. In the figures, elements corresponding to those in other figures are denoted by the same reference numbers, and redundant descriptions are simplified or omitted.

First Embodiment

A first embodiment of the present invention is described in detail with reference to FIGS. 1 through 7.

Figure 1:
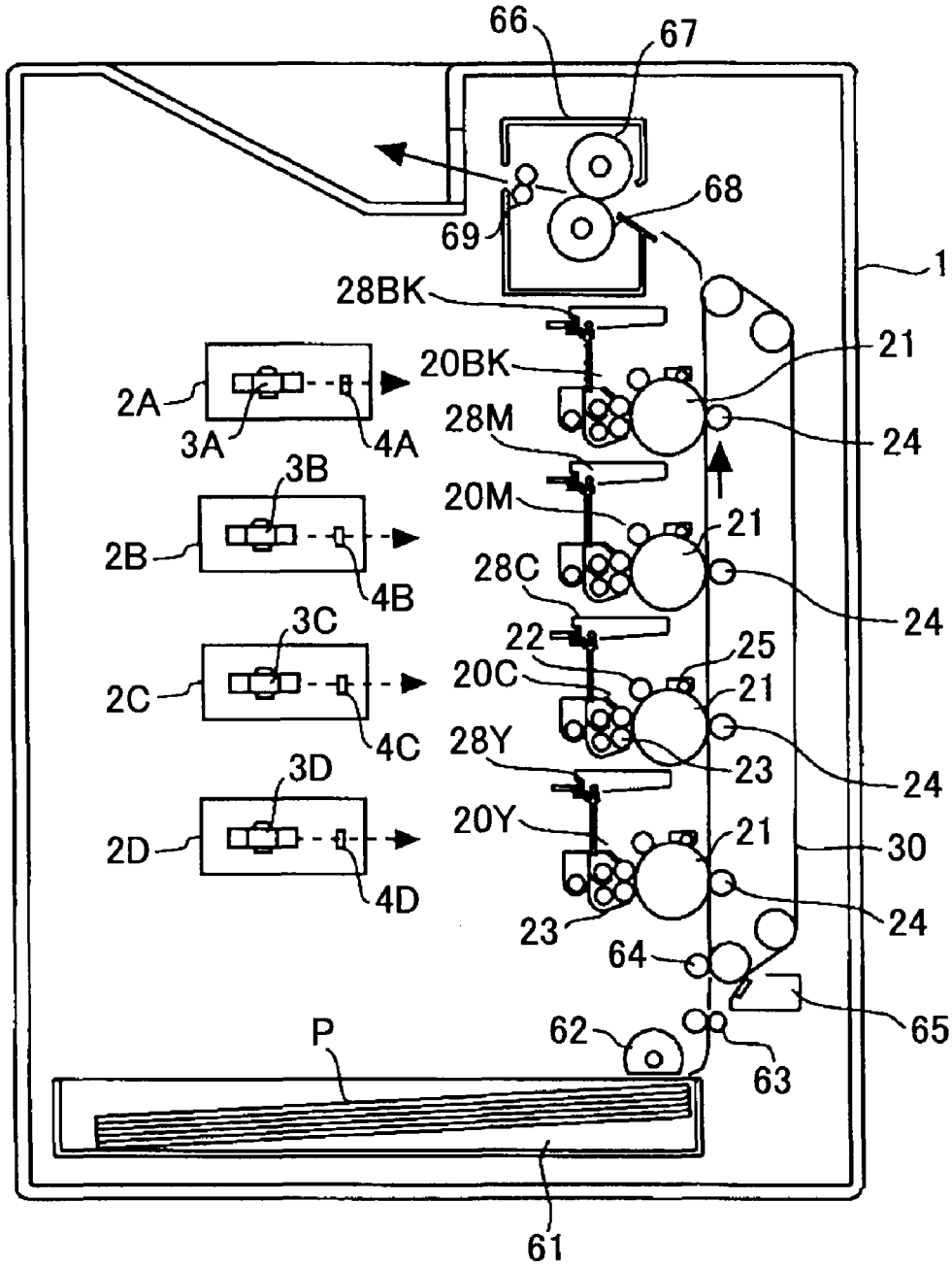
FIG. 1 illustrates the overall configuration of an image forming apparatus according to a first embodiment of the present invention.

The overall configuration and operations of an image forming apparatus according to the first embodiment are described with reference to FIG. 1.

Writing units 2A through 2D are for writing electrostatic latent images on corresponding photoconductive drums 21 (image carriers) after a charging procedure is performed based on image information. The writing units 2A through 2D are optical scanning devices including polygon mirrors 3A through 3D and optical elements 4A through 4D, respectively. It is possible to use LED arrays instead of optical scanning devices as the writing units.

A sheet feeding unit 61 stores transfer materials P onto which images are to be transferred, such as recording paper and OHP transparencies. At the time of forming an image, the sheet feeding unit 61 feeds the transfer materials P to a transfer belt 30 by rotating a sheet feeding roller 62.

The transfer belt 30 is an endless belt, which conveys the transfer material P that is electrostatically adhering to its surface, so that toner images formed on the photoconductive drums 21 are transferred onto the transfer material P. An adhering roller 64 and a belt cleaner 65 are provided on the outer peripheral surface of the transfer belt 30.

A transfer roller 24 facing each photoconductive drum 21 via the transfer belt 30 includes a cored bar and a conductive elastic layer covering the cored bar. The conductive elastic layer of the transfer roller 24 is an elastic body that is adjusted to have an electrical resistance value (volume resistivity) that is mid-level resistance, by mixing and dispersing a conductivity-imparting agent such as carbon black, zinc oxide, and tin oxide in an elastic material such as polyurethane rubber and ethylene propylene diene methylene (EPDM).

A fixing unit 66 includes a heating roller 68 and a pressurizing roller 67, and fixes a toner image onto the transfer material P with pressure and heat.

Four process cartridges 20Y, 20C, 20M, and 20BK disposed in a vertical direction along the transfer belt 30 are for forming toner images of yellow, cyan, magenta, and black, respectively.

On the process cartridges 20Y, 20C, 20M, and 20BK, there are provided agent cartridges 28Y, 28C, 28M, and 28BK, respectively, acting as supplying units for supplying carriers (magnetic carriers) and a toner (toner particles) of corresponding colors (yellow, cyan, magenta, and black) to a corresponding developing device 23.

The process cartridges 20Y, 20C, 20M, and 20BK and the agent cartridges 28Y, 28C, 28M, and 28BK can be attached to/detached from an apparatus main unit 1 by opening the transfer belt 30 in such a manner as to pivot the transfer belt 30 on a rotational support shaft.

The image forming apparatus according to the first embodiment is a multifunctional image forming apparatus, which functions as a copier and a printer. When it functions as a copier, various image processes are performed on image information scanned by a scanner, such as A/D conversion, MTF correction, and a gradation process, to convert the image information into write data. When it functions as a printer, image processes are performed on image information in the page-description language or a bitmap format sent from a computer, to convert the image information into write data.

At the time of forming an image, exposure light beams, corresponding to image information of black, magenta, cyan, and yellow, are irradiated from the writing units 2A through 2D for the process cartridges 20BK, 20M, 20C, and 20Y, respectively. That is, exposure light beams (laser light beams) emitted from the light sources pass through the polygon mirrors 3A through 3D and the optical elements 4A through 4D, and are irradiated onto the corresponding photoconductive drums 21. Accordingly, a toner image corresponding to the exposure light beam is formed on each of the photoconductive drums 21 (image carriers) of the process cartridges 20BK, 20M, 20C, and 20Y. These toner images are to be transferred onto the transfer material P.

The transfer material P temporarily stops at the position of resist rollers 63 so as to be conveyed to the transfer belt 30 at a timing coinciding with a transfer procedure. The adhering roller 64, which is disposed at the position at which the transfer material P is sent onto the transfer belt 30, causes the transfer material P that has been sent onto the transfer belt 30 to adhere to the transfer belt 30 by applying a voltage. The transfer material P moves as the transfer belt 30 moves in a direction indicated by the arrow, and sequentially passes through the positions of the process cartridges 20Y, 20C, 20M, and 20BK, so that toner images of the respective colors are transferred onto the transfer material P in such a manner as to be superposed on one another.

The transfer material P, onto which a color toner image has been transferred, separates from the transfer belt 30 and reaches the fixing unit 66. The toner image resting on the transfer material P is fixed onto the transfer material P by being sandwiched and heated by the heating roller 68 and the pressurizing roller 67. Subsequently, the position on the surface of the transfer belt 30, from which the transfer material P has separated, reaches the position of the belt cleaner 65, where dirt such as toner is cleaned off from the surface of the transfer belt 30.

Next, a detailed description is given of the process cartridges and the agent cartridges in the image forming apparatus.

The process cartridges 20Y, 20C, 20M, and 20BK have substantially the same configuration, and the agent cartridges 28Y, 28C, 28M, and 28BK have substantially the same configuration. Therefore, the alphabetical letters (Y, C, M, and BK) are omitted from the reference numerals of the process cartridge and the agent cartridge shown in FIG. 2. Furthermore, the alphabetical letter (Y, C, M, and BK) is omitted from the reference numeral of the writing unit.

Figure 2:
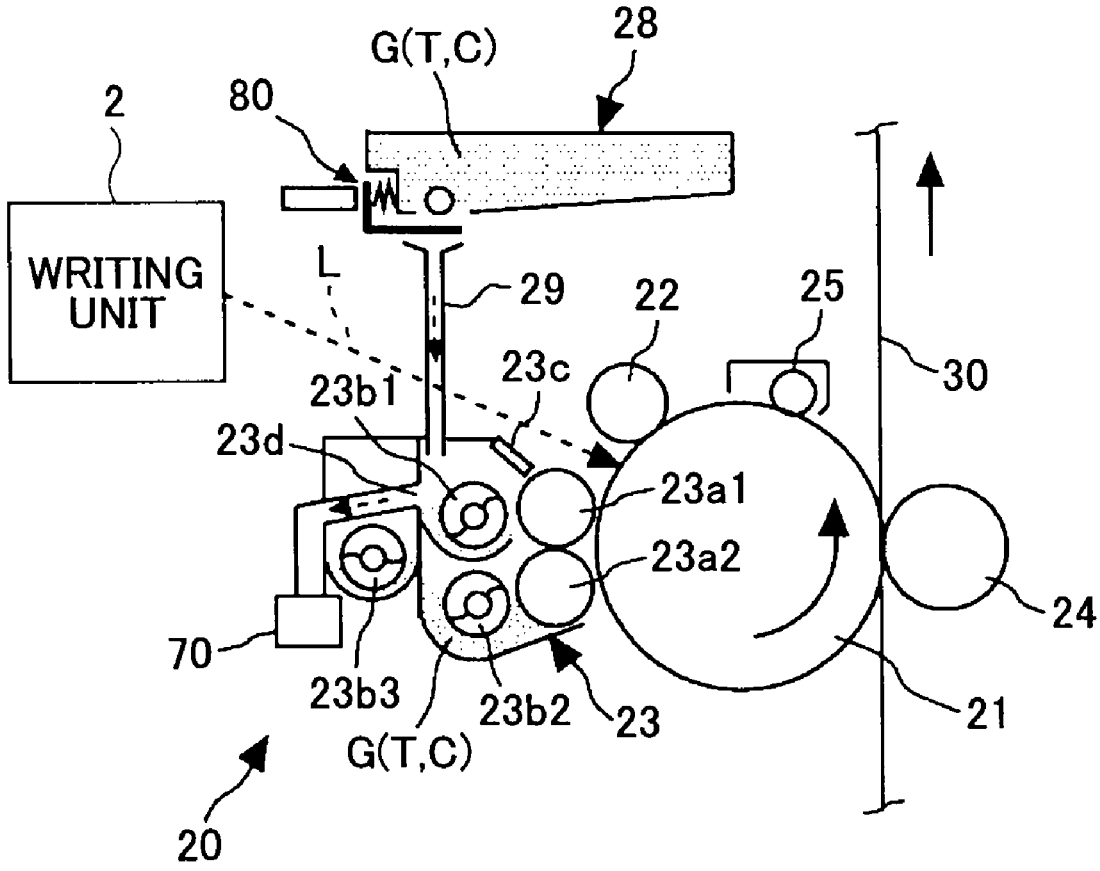
FIG. 2 is an enlarged view of a process cartridge provided in the image forming apparatus shown in FIG. 1.

FIG. 2 is an enlarged view of the process cartridge 20 and the agent cartridge 28 provided in the apparatus main unit 1.

Figure 3:
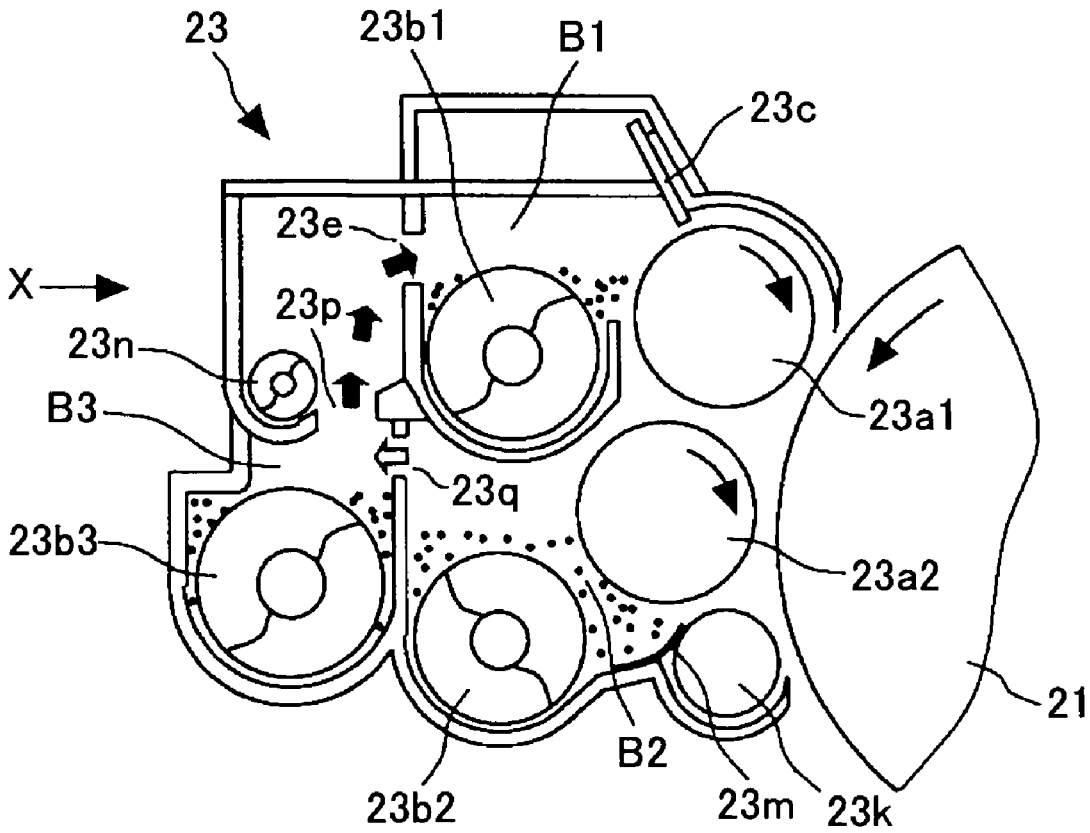
FIG. 3 is an enlarged view of a developing device.
Figure 4:
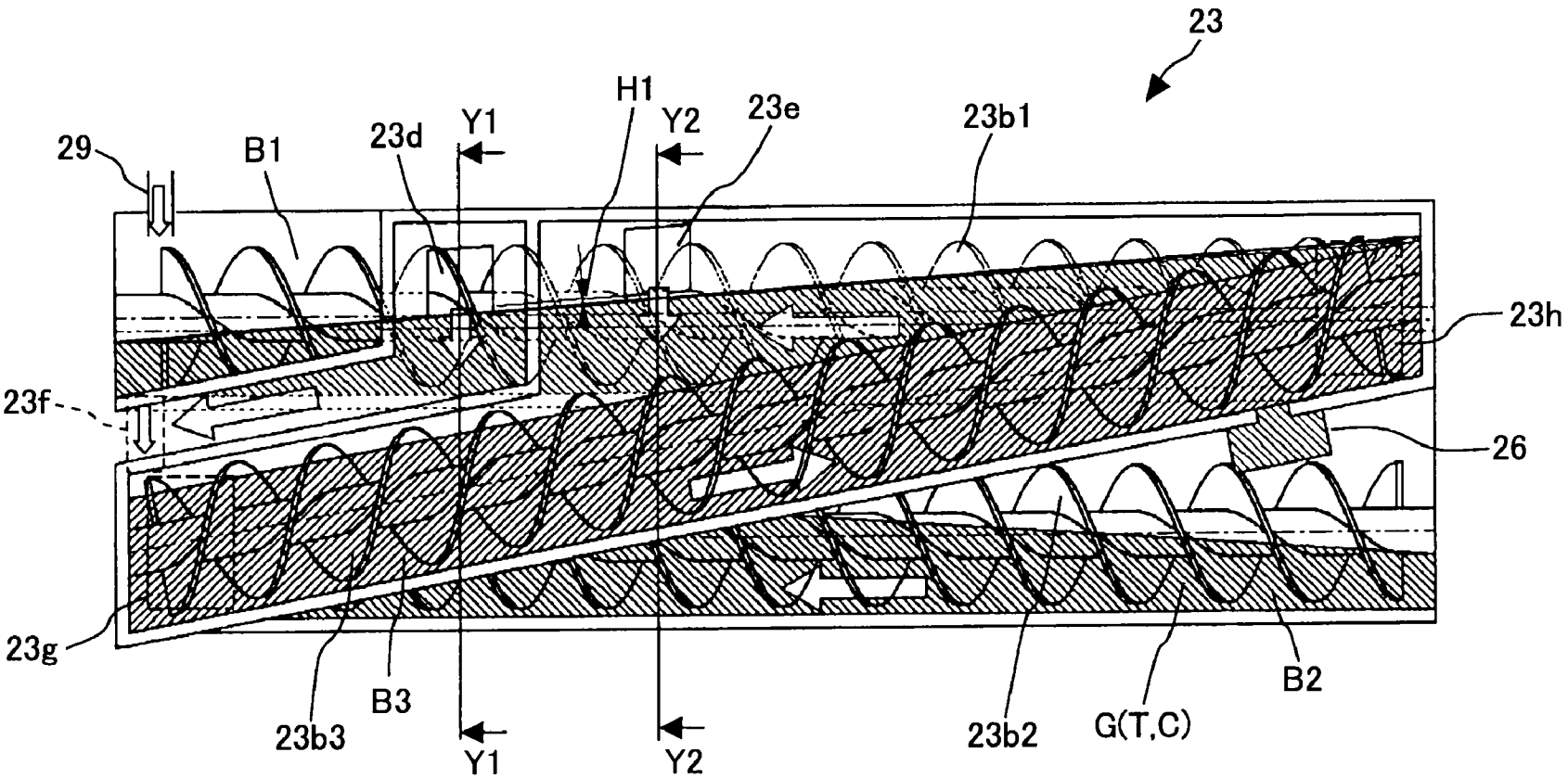
FIG. 4 is a cross-sectional view of circulating paths in the developing device viewed in a lengthwise direction.
Figure 5:
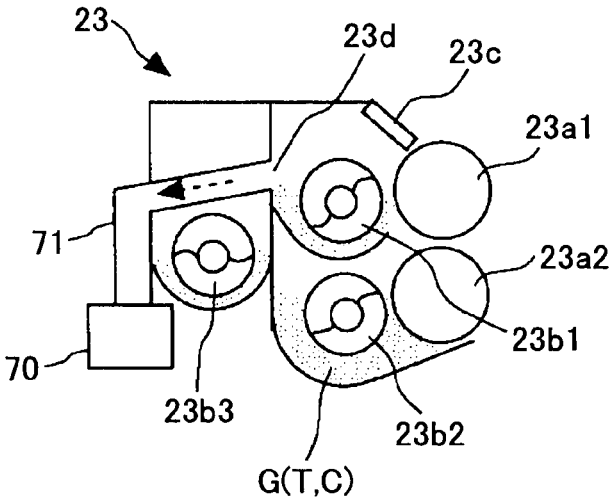
FIG. 5 is a cross-sectional view taken along line Y1-Y1 of the circulating paths shown in FIG. 4.
Figure 6:
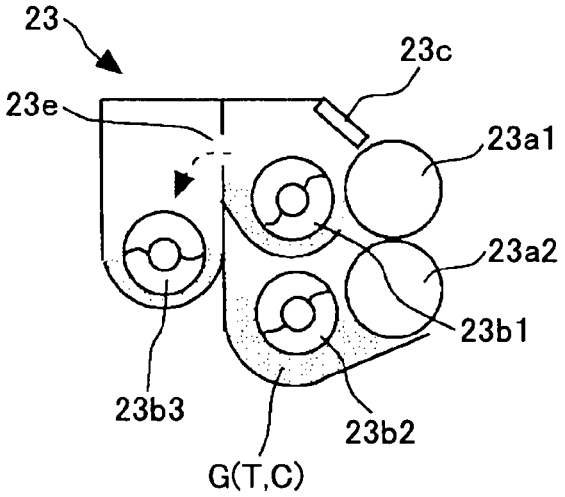
FIG. 6 is a cross-sectional view taken along line Y2-Y2 of the circulating paths shown in FIG. 4.

FIG. 4 is a cross-sectional view of circulating paths in the developing device 23, viewed in a lengthwise direction from a direction indicated by the arrow X shown in FIG. 3. FIG. 5 is a cross-sectional view taken along line Y1-Y1 of the circulating paths in the developing device 23 shown in FIG. 4. FIG. 6 is a cross-sectional view taken along line Y2-Y2 of the circulating paths in the developing device 23 shown in FIG. 4.

As shown in FIG. 2, in the process cartridge 20, the photoconductive drum 21 acting as an image carrier, a charging unit 22, the developing device 23 (developing unit), and a cleaning unit 25 are combined together. A developing method of appropriately supplying/discharging carriers is employed.

The photoconductive drum 21 acting as an image carrier is a negatively charged organic photoconductor, and is rotated in the counter-clockwise direction by a not shown rotational driving mechanism.

The charging unit 22 is a charging roller that has elasticity. Specifically, a urethane foam layer having mid-level resistance is formed on a cored bar in a roller form. The urethane foam layer includes urethane resin, carbon black as conductive particles, a sulfidizing agent, and a foaming agent. The mid-level resistance layer of the charging unit 22 can be made of a rubber material such as urethane, ethylene propylene diene methylene (EPDM), acrylonitrile-butadiene rubber (NBR), silicon gum, and isoprene rubber in which a conductive substance such as carbon black or a metal oxide is dispersed for adjusting the resistance. These materials can be foams. The cleaning unit 25 includes a cleaning brush (or a cleaning blade) that is brushed (rubbed) against the photoconductive drum 21 for mechanically removing/collecting the toner remaining on the photoconductive drum 21 after the transfer procedure.

In the developing device 23, two developing rollers 23*a*1 and 23*a*2 acting as developer carriers are disposed in close contact with the photoconductive drum 21. In between the photoconductive drum 21 and the developing rollers 23*a*1 and 23*a*2, developing regions are formed in which the photoconductive drum 21 contacts magnetic brushes. A developer G (two-component developer) including a toner T and carriers C is accommodated inside the developing device 23. The developing device 23 develops an electrostatic latent image formed on the photoconductive drum 21 (forms a toner image). Configurations and operations of the developing device 23 are described below in detail.

The developing device 23 according to the first embodiment employs a developing method of appropriately supplying/discharging the above-mentioned carriers. Specifically, fresh (new) carriers C (developer G) are appropriately supplied into the developing device 23 from the agent cartridge 28, and the deteriorated developer G is discharged to an agent retaining container 70 provided outside the developing device 23.

Referring to FIG. 2, the developer G (toner T and carriers C) to be supplied into the developing device 23 is accommodated inside the agent cartridge 28. The agent cartridge 28 functions as a toner cartridge for supplying new toner T to the developing device 23, and also functions as a supplying unit for supplying the new carriers C to the developing device 23. Specifically, based on information on the toner density (the proportion of toner in the developer G) detected by a magnetic sensor 26 (see FIG. 4) provided in the developing device 23, an operation of opening/closing a shutter mechanism 80 is performed to appropriately supply the developer G into the developing device 23 from the agent cartridge 28 acting as the supplying unit.

In the first embodiment, the mixing ratio (toner density) of the toner T with respect to the carriers C in the developer G in the agent cartridge 28 is set to be relatively high.

A supplying pipe 29 acting as a supplying unit is for reliably guiding the developer G (toner T and carriers C) supplied from the agent cartridge 28 into the developing device 23. That is, the developer G that has been discharged from the agent cartridge 28 is supplied into the developing device 23 via the supplying pipe 29.

Next, a description is given of an image creating process performed on the photoconductive drum 21.

Referring to FIG. 2, when the photoconductive drum 21 is rotated in the counter-clockwise direction, first, the surface of the photoconductive drum 21 is uniformly charged at the position of the charging unit 22. Subsequently, the charged surface of the photoconductive drum 21 reaches an irradiation position of an exposure light beam L, where the writing unit 2 performs an exposing procedure. That is, by irradiating the exposure light beam L, the photoconductive drum 21 is selectively neutralized according to image information. Accordingly, a difference in the electric potential is generated between the irradiated parts and the non-image parts that are not irradiated (potential contrast), thereby forming an electrostatic latent image. In the exposing procedure, electric charges are generated as electric charge generating substances receive light in the photoconductive layer of the photoconductive drum 21. Among these, the positive holes and the electrical charges on the surface of the photoconductive drum 21 cancel each other out.

Subsequently, the surface of the photoconductive drum 21 on which a latent image is formed reaches a position that faces the developing device 23. The electrostatic latent image on the photoconductive drum 21 contacts magnetic brushes on the developing rollers 23*a*1 and 23*a*2, so that the negatively charged toner T in the magnetic brushes adheres to the electrostatic latent image and the electrostatic latent image becomes visible.

Specifically, the developer G is lifted by the magnetic force of the magnetic pole of the upper developing roller 23*a*1. Then, the developer G is reduced to an appropriate amount by a doctor blade 23*c*. Subsequently, the developer G is conveyed to a developing region that is facing the photoconductive drum 21 (the region where the two developing rollers 23*a*1 and 23*a*2 face the photoconductive drum 21). The carriers C, which are forming ears (piling up in a tall and thin manner) in the developing region, brush the photoconductive drum 21. At this time, the toner T mixed in the carriers C are negatively charged due to friction between the carriers C. Conversely, the carriers are positively charged. A predetermined developing bias is applied to the developing rollers 23*a*1 and 23*a*2 by a not shown power source unit. Accordingly, an electric field is formed between the developing rollers 23*a*1 and 23*a*2 and the photoconductive drum 21. As a result, the negatively charged toner T selectively adheres only to the image parts on the photoconductive drum 21 due to the electric field, thereby forming a toner image.

Subsequently, a part on the surface of the photoconductive drum 21 at which a toner image is formed reaches the position facing the transfer belt 30 and the transfer roller 24. Then, the toner image on the photoconductive drum 21 is transferred onto the transfer material P being conveyed to this position at a coinciding timing. At this time, a predetermined voltage is applied to the transfer roller 24.

Subsequently, the transfer material P onto which the toner image has been transferred passes through the fixing unit 66, and is then ejected outside the apparatus by eject rollers 69.

Meanwhile, the toner T (non-transfer toner) remaining on the photoconductive drum 21, which has not been transferred onto the transfer material P at the time of the transfer procedure, remains adhering on the photoconductive drum 21 when it reaches the position facing the cleaning unit 25. Then, the non-transfer toner on the photoconductive drum 21 is removed/collected at the cleaning unit 25.

Subsequently the surface of the photoconductive drum 21 passes through a not shown neutralizing unit, thereby completing the series of steps of the image creating process for the photoconductive drum 21.

A detailed description of characteristic configurations and operations of the developing device in the image forming apparatus is given below. With reference to FIG. 3, the developing device 23 includes the developing rollers 23*a*1 and 23*a*2 acting as developer carriers, conveying screws 23*b*1 through 23*b*3 acting as conveying members (auger screws), the doctor blade 23*c*, a catch roller 23*k*, a scraper 23*m*, a discharge screw 23*n*, etc. Inside the developing device 23, three developer conveying units B1 through B3 are formed, which convey the developer G and form circulating paths.

The developing rollers 23*a*1 and 23*a*2 are configured in such a manner that sleeves are made by forming cylindrical shapes with non-magnetic bodies such as aluminum, brass, stainless steel, conductive resin, etc. These sleeves are rotated in the clockwise direction by a not shown rotational driving mechanism. Magnets are fixed inside the sleeves of the developing rollers 23*a*1 and 23*a*2, which magnets form a magnetic field for causing the developer G to form ears on the peripheral surfaces of the sleeves. The carriers C in the developer G form ears on the sleeves in a chain-like manner, which ears are formed along magnetic force lines in normal line directions emitted from the magnets. The charged toner T adheres to these carriers C which are forming ears in a chain-like manner, thereby forming magnetic brushes. As the sleeve is rotated, the magnetic brush moves in the same direction as the sleeve (clockwise direction).

The doctor blade 23*c* is disposed at the upstream side of the developing region for limiting the developer on the developing roller 23*a*1 to an appropriate amount.

The three conveying screws 23*b*1 through 23*b*3 stir/mix the developer G accommodated in the developing device 23, while circulating the developer G in a lengthwise direction (vertical direction with respect to the sheet in FIG. 2).

The first conveying screw 23*b*1 (first conveying member) is disposed at a position of the first developer conveying unit B1, facing the developing roller 23*a*1. The first conveying screw 23*b*1 conveys the developer G in a horizontal direction (in a left direction as indicated by a white arrow in FIG. 4), and supplies the developer G onto the developing roller 23*a*1. That is, the first developer conveying unit B1 faces the developing roller 23*a*1, and supplies the developer G to the developing roller 23*a*1 while conveying the developer G in the lengthwise direction (rotation axis direction of the developing roller 23*a*1).

The second conveying screw 23*b*2 (second conveying member) is disposed at the second developer conveying unit B2. The second conveying screw 23*b*2 is disposed at a position underneath the first conveying screw 23*b*1, facing the developing roller 23*a*2. The second conveying screw 23*b*2 conveys the developer G that has separated from the developing roller 23*a*2 (the developer G that has been forcibly separated from the developing roller 23*a*2 by a developer separating pole after the developing procedure). That is, the second developer conveying unit B2 is disposed at a position underneath the first developer conveying unit B1, facing the developing roller 23*a*2, and conveys the developer G that has separated from the developing roller 23*a*2 in a lengthwise direction.

Each of the first conveying screw 23*b*1 and the second conveying screw 23*b*2 is disposed in such a manner that its rotation axis is substantially horizontal, similar to the developing rollers 23*a*1, 23*a*2 and the photoconductive drum 21.

The third conveying screw 23*b*3 (third conveying member) is disposed at the third developer conveying unit B3. The third conveying screw 23*b*3 is disposed obliquely with respect to a horizontal direction, in such a manner as to linearly connect the downstream side of the conveying path formed by the second conveying screw 23*b*2 and the upstream side of the conveying path formed by the first conveying screw 23*b*1 (see FIG. 4). The third conveying screw 23*b*3 conveys the developer G, which has been conveyed by the second conveying screw 23*b*2, to an upstream side of a conveying path formed by the first conveying screw 23*b*1, and conveys the developer G being circulated from the downstream side of the conveying path formed by the first conveying screw 23*b*1 via a dropping path 23*f* to the upstream side of the conveying path formed by the first conveying screw 23*b*1 (in an obliquely right and upward direction as indicated by a white arrow in FIG. 4). That is, the third developer conveying unit B3 conveys the developer G conveyed by the second developer conveying unit B2 to the upstream side of the first developer conveying unit B1, and conveys the developer G that has reached the downstream side of the first developer conveying unit B1 to the upstream side of the first developer conveying unit B1.

The conveying path formed by the first conveying screw 23*b*1 (first developer conveying unit B1), the conveying path formed by the second conveying screw 23*b*2 (second developer conveying unit B2), and the conveying path formed by the third conveying screw 23*b*3 (third developer conveying unit B3) are partitioned by walls.

Referring to FIG. 4, the downstream side of the second developer conveying unit B2 and the upstream side of the third developer conveying unit B3 are in communication with each other via a first relay unit 23*g*. The downstream side of the third developer conveying unit B3 and the upstream side of the first developer conveying unit B1 are in communication with each other via a second relay unit 23*h*. The downstream side of the first developer conveying unit B1 and the upstream side of the third developer conveying unit B3 are in communication with each other via the dropping path 23*f*.

With such a configuration, the three developer conveying units B1 through B3 (conveying screws 23*b*1 through 23*b*3) form circulating paths for circulating the developer G in the lengthwise direction in the developing device 23. When the developing device 23 is operated, the developer accommodated in the device flows in the hatched area. Referring to FIG. 4, in the first developer conveying unit B1, the surface of the developer on the downstream side is lower than the surface of the developer on the upstream side. This is because some of the developer is supplied to the developing roller 23*a*1 while being conveyed. That is, the developer that is not supplied to the developing roller 23*a*1 moves to the upstream side of the third developer conveying unit B3 via the dropping path 23*f*.

The third developer conveying unit B3 is provided with the magnetic sensor 26 as a toner density sensor. Based on information on the toner density detected by the magnetic sensor 26, the developer G having a predetermined toner density is supplied into the developing device 23 from the agent cartridge 28 acting as the supplying unit.

Referring to FIGS. 4 and 5, a discharge outlet 23*d* acting as a discharge unit is provided in the first developer conveying unit B1 for discharging part of the developer G accommodated in the developing device 23 to the outside (agent retaining container 70). Specifically, when the developer G is supplied into the developing device 23 by the supplying units 28, 29, and the amount of the developer in the device increases such that the developer surface (top surface) of the developer conveyed to the position of the discharge outlet 23*d* exceeds a predetermined height, the excessive amount of the developer G (the amount exceeding the predetermined height) is discharged toward the agent retaining container 70. The excessive developer G that exceeds the height of the bottom part of the discharge outlet 23*d*, is discharged from the discharge outlet 23*d*, and falls down by gravity to the agent retaining container 70 via a discharge path 71. As described above, deteriorated carriers that have been soiled by the matrix resin of the toner T and an external additive are automatically discharged outside the developing unit, and therefore it is possible to prevent the image quality from degrading with the passage of time.

Although not shown in FIGS. 2 and 4, the discharge screw 23*n* is disposed inside the discharge path 71 for conveying the developer discharged from the discharge outlet 23*d* in a horizontal direction (see FIG. 3).

In the circulating paths for the developer in the developing device 23, a bypass path is formed so that part of the developer G can return to the upstream side of the circulating paths without passing through the position of the above-described discharge outlet 23*d* (discharge unit). Specifically, referring to FIGS. 4 and 6, an opening 23*e* (first opening) is provided in the first developer conveying unit B1, on the upstream side of the discharge outlet 23*d* (relatively near the discharge outlet 23*d*). This opening 23*e* acts as an inlet of the bypass path. An opening 23*p* that acts as an outlet of the bypass path (second opening, see FIG. 3) is provided in the conveying path formed by the third conveying screw 23*b*3 (around the center in the lengthwise direction).

As described above, by providing a bypass path in the circulating path for the developer in the developing device 23, the following effects can be achieved. That is, even if the developer in the developing device becomes uneven in a wave-like manner, the bypass path will prevent the amount of developer discharged from the discharge outlet 23*d* from becoming uneven. Accordingly, it will be possible to prevent an excessive amount of developer being discharged from the developing device 23.

Figure 7:
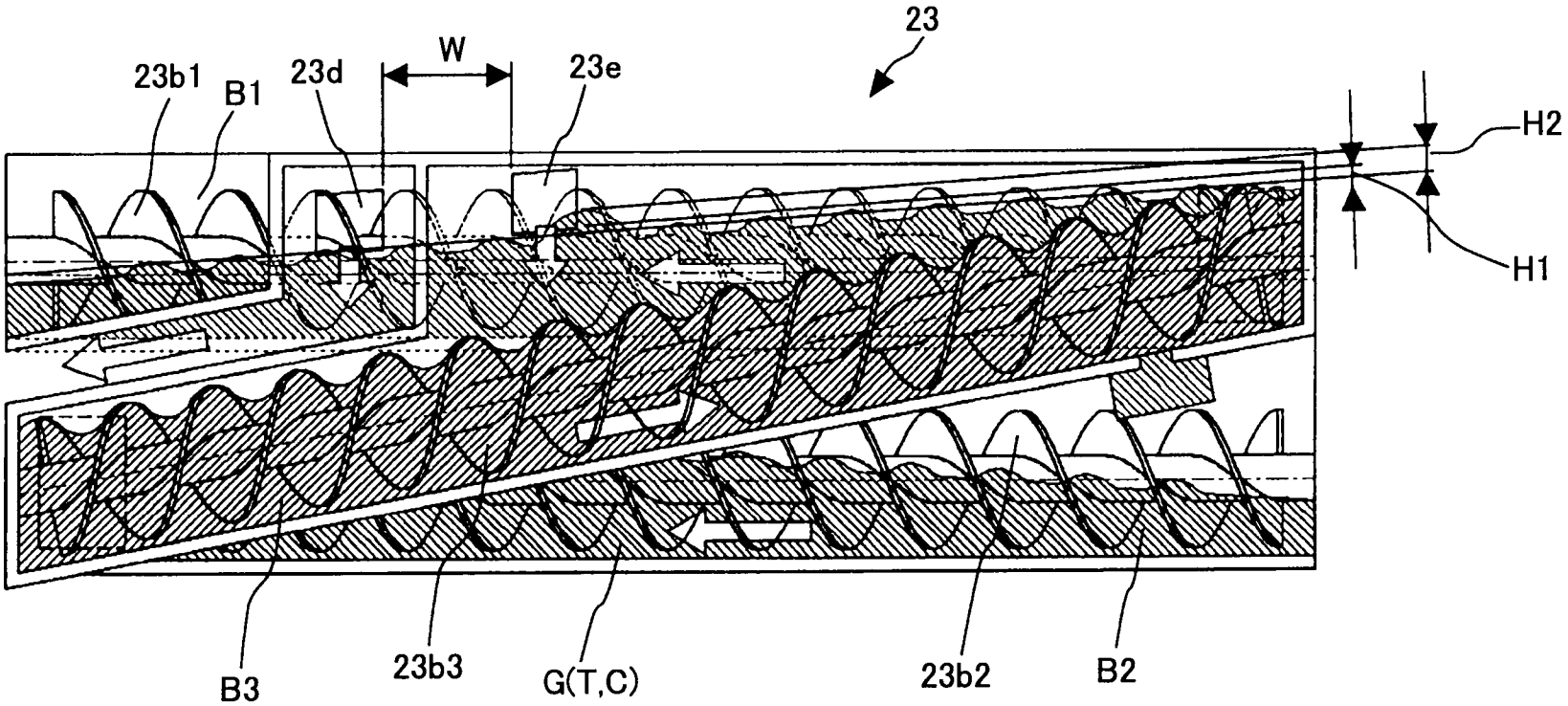
FIG. 7 illustrates where the developer has become uneven in a wave-like manner in the circulating paths shown in FIG. 4.

FIG. 7 illustrates where the developer has become uneven in a wave-like manner in the circulating paths for the developer in the developing device 23. As illustrated, the developer may become uneven, creating large waves. Such wave-like unevenness becomes significant immediately after the developing device 23 starts to operate (immediately after restart). In the conventional technology, if the developer becomes uneven in such a wave-like manner, all of the developer exceeding the height of the bottom part of the discharge outlet 23*d* (the developer corresponding to a height H2 shown in FIG. 7) is discharged from the discharge outlet 23*d*. This discharged developer is more than the amount that is originally intended to be discharged. Therefore, if such a phenomenon repeatedly occurs, the amount of the developer inside the developing device 23 will become insufficient. As a result, the deterioration state of the developer will become unstable and the charge level of the toner will decrease, which leads to failures such as a decrease in the image density of the output image.

Conversely, in the first embodiment, the opening 23*e*, which is in communication with the bypass path, is provided on the upstream side of the discharge outlet 23*d*. Therefore, the part of the developer that exceeds the height of the bottom part of the opening 23*e* will not be discharged from the discharge outlet 23*d*. Instead, this part of the developer will exit the opening 23*e* and return to the conveying path formed by the third conveying screw 23*b*3. Accordingly, it is possible to prevent an excessive amount of developer from being discharged from the discharge outlet 23*d*.

The height of the bottom part of the opening 23*e* of the bypass path is configured in such a manner as to be higher than the bottom part of the discharge outlet 23*d* by a height H1.

Accordingly, among the developer that exceeds the height of the bottom part of the discharge outlet 23*d*, the developer corresponding to a height of H2-H1 is not discharged from the discharge outlet 23*d* but instead is returned to the conveying path, which is formed by the third conveying screw 23*b*3, through the opening 23*e*. Therefore, it is possible to reliably prevent excessive developer from being discharged from the discharge outlet 23*d* while maintaining the intended function of the discharge unit. A distance W between the discharge outlet 23*d* and the opening 23*e* in the lengthwise direction is preferably short.

In the first embodiment, the bypass paths 23*e* and 23*p* function as part of a ventilation unit for performing ventilation among the plural developer conveying units B1 through B3, which ventilation unit is described below in detail.

Referring to FIG. 3 (not shown in FIGS. 2 and 4), in the first embodiment, the catch roller 23*k* is provided at a position below the developing roller 23*a*2, facing the photoconductive drum 21. Furthermore, the scraper 23*m* is disposed in contact with the catch roller 23*k*.

The catch roller 23*k* is a cylindrical body made of, for example, stainless steel, with a magnet fixed inside for forming a predetermined magnetic field. The catch roller 23*k* is for capturing carriers adhering to the photoconductive drum 21 after the developing procedure. The catch roller 23*k* is rotated in the counter clockwise direction as viewed in FIG. 3. The carriers that are captured and carried by the catch roller 23*k* are mechanically scraped off by the scraper 23*m* and collected inside the second developer conveying unit B2. By providing the catch roller 23*k*, the amount of carriers adhering to the photoconductive drum 21 can be reduced, thereby preventing a shortage of carriers inside the developing device 23.

The following is a detailed description of the ventilation unit in the developing device, which is characteristic of the first embodiment. Referring to FIG. 3, the developing device 23 according to the first embodiment includes the openings 23*e*, 23*p*, and 23*q*, acting as a ventilation unit for performing ventilation between a developer conveying unit whose internal pressure increases and a developer conveying unit whose internal pressure decreases, among the three developer conveying units B1 through B3. The ventilation unit is configured with a first ventilation path and a second ventilation path.

Specifically, the openings 23*e* and 23*p* functioning as the bypass path, also function as the first ventilation path that is in communication with the first developer conveying unit B1 and the third developer conveying unit B3. Furthermore, the third opening 23*q* functions as the second ventilation path that is in communication with the second developer conveying unit B2 and the third developer conveying unit B3.

With such a configuration, it is possible to prevent the internal pressure from changing separately in the three developer conveying units B1 through B3 that are partitioned by walls.

In the second developer conveying unit B2, a suction airflow is generated as the developing roller 23*a*2 rotates, and the internal pressure becomes higher than the external pressure (positive pressure). Accordingly, the toner floating inside the second developer conveying unit is blown out from gaps of the device (for example, from gaps at both edges of the developing roller 23*a*2 in the lengthwise direction) and scatters outside.

In the first developer conveying unit B1, a blowout airflow is generated as the developing roller 23*a*1 rotates, and the internal pressure becomes lower than the external pressure (negative pressure). Accordingly, the efficiency of passing the developer from the first developer conveying unit B1 to the third developer conveying unit B3 decreases, and redundant toner is scattered outside the device. Specifically, the toner supplied at the downstream side of the first developer conveying unit B1 flows upstream in the first developer conveying unit B1, and then scatters outside the device.

Meanwhile, in the first embodiment, the opening 23*e* and the opening 23*p* (first ventilation path) are provided in the walls partitioning the first developer conveying unit B1 and the third developer conveying unit B3, and the opening 23*q* (second ventilation path) is provided in the wall partitioning the second developer conveying unit B2 and the third developer conveying unit B3. Therefore, the internal pressures in the three developer conveying units B1 through B3 are substantially balanced.

Specifically, air flows from the second developer conveying unit B2 which is at a positive pressure, to the third developer conveying unit B3 at a lower internal pressure than the second developer conveying unit B2, via the second ventilation path 23*q* (ventilation in the direction indicated by a white arrow). Furthermore, air flows from the third developer conveying unit B3 to the first developer conveying unit B1 which is at a negative pressure (vacuum), via the first ventilation path 23*e*, 23*p* (bypass path) (ventilation in the direction indicated by black arrows).

Accordingly, the internal pressure of the second developer conveying unit B2 that has been at a positive pressure becomes near to the external pressure, and the internal pressure of the first developer conveying unit B1 that has been at a negative pressure becomes near to the external pressure. Therefore, the suction airflow of the second developer conveying unit B2 and the blowout airflow of the first developer conveying unit B1 substantially vanish. As a result, the amount of toner scattered from the first developer conveying unit B1 and the second developer conveying unit B2 is reduced.

The first ventilation path 23*e*, 23*p* and the second ventilation path 23*q* acting as the ventilation unit are preferably disposed at positions that will not be buried by the developer G accommodated in the developing device 23. Accordingly, the effects of the ventilation unit can be reliably achieved.

As described above, in the first embodiment, the openings 23*e*, 23*p*, and 23*q* (ventilation unit) are provided for performing ventilation between the second developer conveying unit B2 whose internal pressure increases and the first developer conveying unit B1 whose internal pressure decreases. Accordingly, even when plural developer conveying units B1 through B3 are provided, the amount of scattered toner can be reliably reduced.

In the first embodiment, the present invention is applied to the developing device 23 including three developer conveying units B1 through B3. However, the present invention is also applicable to a developing device including two developer conveying units or four or more developer conveying units. In such a case, the developer conveying units having different internal pressures can be directly or indirectly connected by ventilation paths; therefore the same effects as the first embodiment can be achieved.

In the first embodiment, the third conveying screw 23*b*3 is disposed obliquely with respect to a horizontal direction; however, the third conveying screw 23*b*3 can be disposed horizontally.

Furthermore, in the first embodiment, the developer G (toner T and carriers C) is supplied to the developing device 23 from the agent cartridge 28 acting as a supplying unit; however, it is also possible to supply only the carriers C from the supplying unit to the developing device 23. In this case, a toner cartridge that only accommodates toner is provided separately from the agent cartridge (carrier cartridge), and the toner accommodated in the toner cartridge is appropriately supplied to the developing device 23 based on detection results of the magnetic sensor 26. In this case, the same effects as the first embodiment can be achieved.

In the first embodiment, the present invention is applied to the image forming apparatus in which the process cartridge 20 configures a part of the image creating unit. However, the present invention is not limited thereto. As a matter of course, the present invention is applicable to an image forming apparatus in which the image creating unit is not configured with a process cartridge. Specifically, as a matter of course, the present invention is applicable in a case where the developing device 23 is configured as a single unit that is detachably attached to the main unit of the image forming apparatus.

Furthermore, in the first embodiment, the present invention is applied to the developing device 23 provided with two developing rollers 23*a*1 and 23*a*2. However, the present invention is also applicable to a developing device including one developing roller or three or more developing rollers. In such a case, the same effects as the first embodiment can be achieved.

Second Embodiment

A second embodiment according to the present invention is described in detail with reference to FIG. 8.

Figure 8:
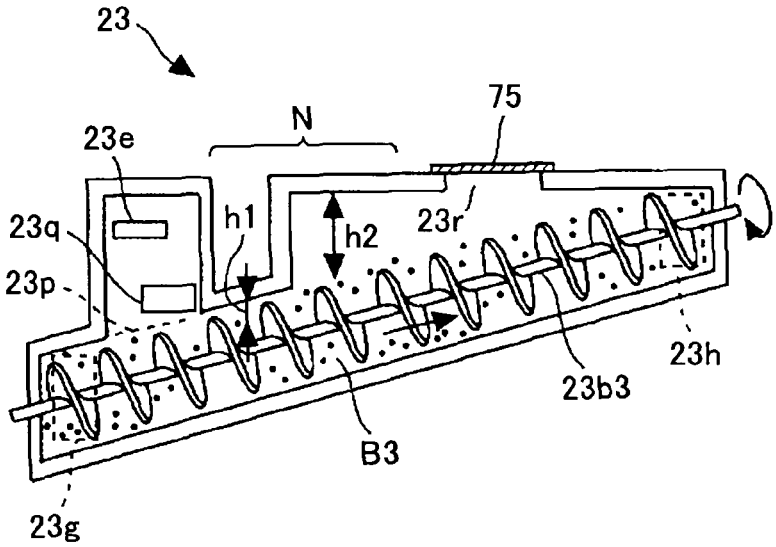
FIG. 8 is a cross-sectional view of a third developer conveying unit of a developing device according to a second embodiment of the present invention.

FIG. 8 is a cross-sectional view of the third developer conveying unit of a developing device according to the second embodiment, viewed from the X direction of FIG. 3. The developing device according to the second embodiment is different from that of the first embodiment in that the third developer conveying unit B3 is provided with an internal pressure adjusting unit N, a ventilation hole 23*r*, and a filter 75.

Similar to that of the first embodiment, the developing device 23 according to the second embodiment is provided with the three developer conveying units B1 through B3 that form the circulating paths for conveying the developer G accommodated in the developing device 23.

In the second embodiment, as shown in FIG. 8, the internal pressure adjusting unit N is provided in the third developer conveying unit B3 in such a manner that a height h1 from the surface of the developer to the top wall at the upstream side is lower than a height h2 from the surface of the developer to the top wall at the downstream side (h1<h2). The internal pressure adjusting unit N is disposed near the opening 23*q* acting as the second ventilation path, and on the downstream side of the opening 23*q* (corresponding to the downstream side of the conveyance direction of the developer in the third developer conveying unit B3).

With such a configuration, air that has flowed into the third developer conveying unit B3 from the second developer conveying unit B2 through the opening 23*q* moves to the first developer conveying unit B1 via the first ventilation path 23*e*, 23*p*, and moves to the downstream side of the third developer conveying unit B3 by a pumping function of the internal pressure adjusting unit N (the air is pushed out from the region of the height h1 to the region of the height h2).

Accordingly, by providing the internal pressure adjusting unit N, the following effects can be achieved. That is, there may be a case where the internal pressure that increases in the second developer conveying unit B2 (internal pressure variation) is larger than the internal pressure that decreases in the first developer conveying unit B1 (internal pressure variation). In such a case, the internal pressure in both of the developer conveying units B1 and B2 may not come near the external pressure simply by making the air flow from the second developer conveying unit B2 to the first developer conveying unit B1. However, if the internal pressure adjusting unit N is provided, the overall-all balance of the internal pressure may be adjusted in the third developer conveying unit B3, so that the internal pressure in both of the developer conveying units B1 and B2 comes near the external pressure. Thus, the amount of toner scattered from the developing device 23 can be reliably reduced.

In the second embodiment, the ventilation hole 23*r* that is in communication with the outside of the developing device 23 and the filter 75 covering the developing device 23 are provided on the top wall of the third developer conveying unit B3, in order to prevent the internal pressure of the third developer conveying unit B3 from increasing due to the air that has moved to the downstream side of the third developer conveying unit B3 by the pumping function of the internal pressure adjusting unit N. Accordingly, it is preferable to use, as the filter 75, a filter that can reliably capture the toner, so that only air is discharged (or suctioned) without scattering toner from the third developer conveying unit B3.

As described above, in the second embodiment, similar to the first embodiment, the openings 23*e*, 23*p*, and 23*q* (ventilation unit) are provided for performing ventilation between the second developer conveying unit B2 whose internal pressure increases and the first developer conveying unit B1 whose internal pressure decreases. Accordingly, even when plural developer conveying units B1 through B3 are provided, the amount of scattered toner can be reliably reduced.

Third Embodiment

A third embodiment according to the present invention is described in detail with reference to FIG. 9.

Figure 9:
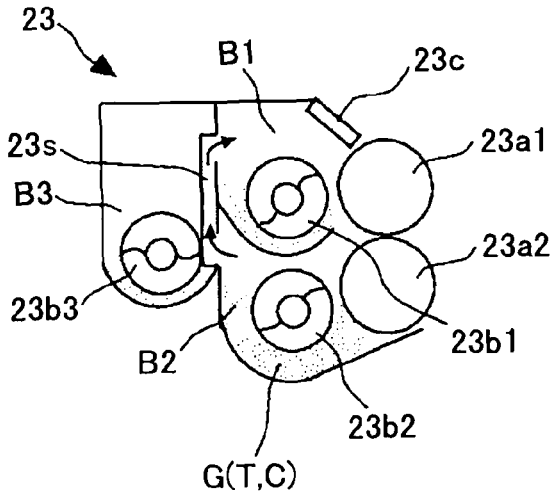
FIG. 9 is a cross-sectional view of a developing device according to a third embodiment of the present invention.

FIG. 9 is a cross-sectional view of a developing device according to the third embodiment. The developing device according to the third embodiment is different from that of the first embodiment in that a ventilation path 23*s* is provided for directly connecting the first developer conveying unit B1 to the second developer conveying unit B2.

Similar to that of the first embodiment, the developing device 23 according to the third embodiment is provided with the three developer conveying units B1 through B3 that form the circulating paths for conveying the developer G accommodated in the developing device 23.

In the third embodiment, as shown in FIG. 9, the ventilation path 23*s* is provided so that the first developer conveying unit B1 is in direct communication with the second developer conveying unit B2. The ventilation path 23*s* is positioned such that its openings on both ends will not be buried by the developer inside the developing device 23. The ventilation path 23*s* functions as a ventilation unit for performing ventilation between the first developer conveying unit B1 and the second developer conveying unit B2. That is, the air flows from the second developer conveying unit B2 that is at a positive pressure to the first developer conveying unit B1 that is at a negative pressure via the ventilation path 23*s* (ventilation in the direction indicated by the arrows).

As described above, in the third embodiment, similar to the first embodiment, the ventilation path 23*s* (ventilation unit) is provided for performing ventilation between the second developer conveying unit B2 whose internal pressure increases and the first developer conveying unit B1 whose internal pressure decreases. Accordingly, even when plural developer conveying units B1 through B3 are provided, the amount of scattered toner can be reliably reduced.

According to one embodiment of the present invention, a developing device is provided for accommodating a developer including carriers and a toner, and for developing a latent image formed on an image carrier, the developing device including plural developer conveying units configured to convey the developer accommodated in the developing device, and form circulating paths; and a ventilation unit configured to perform ventilation between at least one of the developer conveying units whose internal pressure increases and at least one of the developer conveying units whose internal pressure decreases.

Additionally, according to one embodiment of the present invention, the developing device further includes a developer carrying body facing the image carrier, the developer carrying body being configured to carry the developer, wherein the plural developer conveying units include a first developer conveying unit facing the developer carrying body, the first developer conveying unit being configured to supply the developer to the developer carrying body while conveying the developer in a lengthwise direction; a second developer conveying unit disposed at a position that is underneath the first developer conveying unit and that faces the developer carrying body, the second developer conveying unit being configured to convey, in the lengthwise direction, the developer that has separated from the developer carrying body; and a third developer conveying unit configured to convey the developer, which has been conveyed by the second developer conveying unit, to an upstream side of the first developer conveying unit and to convey the developer, which has reached a downstream side of the first developer conveying unit, to the upstream side of the first developer conveying unit.

Additionally, according to one embodiment of the present invention, in the developing device, the ventilation unit includes a first ventilation path for communicating between the first developer conveying unit and the third developer conveying unit; and a second ventilation path for communicating between the second developer conveying unit and the third developer conveying unit.

Additionally, according to one embodiment of the present invention, in the developing device, the first ventilation path and the second ventilation path are disposed at positions that are not buried by the developer accommodated in the developing device.

Additionally, according to one embodiment of the present invention, in the developing device, the third developer conveying unit includes an internal pressure adjusting unit that is formed in such a manner that a first height from a developer surface of the developer to a top wall at an upstream side of the third developer conveying unit is lower than a second height from the developer surface of the developer to the top wall at a downstream side of the third developer conveying unit.

Additionally, according to one embodiment of the present invention, in the developing device, the second ventilation path includes an opening provided on a wall partitioning the second developer conveying unit and the third developer conveying unit; and the internal pressure adjusting unit is disposed at a downstream side with respect to the opening in a direction of conveying the developer in the third developer conveying unit.

Additionally, according to one embodiment of the present invention, in the developing device, the third developer conveying unit includes a ventilation hole for communicating with the outside of the developing device, and a filter configured to cover the ventilation hole.

Additionally, according to one embodiment of the present invention, the developing device further includes a supplying unit configured to supply new carriers to the developing device; a discharge unit configured to discharge, to the outside, a part of the developer accommodated in the developing device; and a bypass path through which a part of the developer returns to an upstream side of the circulating paths without passing through a position where the discharge unit is disposed, wherein the bypass path includes a part of the ventilation unit.

Additionally, according to one embodiment of the present invention, in the developing device, the supplying unit is configured to supply new toner to the developing device, together with the new carriers.

Additionally, according to one embodiment of the present invention, a process cartridge that is detachably attached to a main unit of an image forming apparatus is provided, wherein the above described developing device and the image carrier form a single unit.

Additionally, according to one embodiment of the present invention, an image forming apparatus is provided, which includes the above described developing device; and the image carrier.

The present invention is not limited to the specifically disclosed embodiment, and variations and modifications may be made without departing from the scope of the present invention.

The present application is based on Japanese Priority Patent Application No. 2007-038888, filed on Feb. 20, 2007, and Japanese Priority Patent Application No. 2007-090168, filed on Mar. 30, 2007 the entire contents of which are hereby incorporated by reference.

What is claimed is:

1. A developing device for accommodating a developer including carriers and a toner, and for developing a latent image formed on an image carrier, the developing device comprising:

a plurality of developer conveying units configured to convey the developer accommodated in the developing device, and form circulating paths;

a plurality of developer apertures configured to allow conveyance of developer between two or more of the plurality of developer conveying units, the plurality of developer apertures disposed proximate to one or more ends of the developing device in a lengthwise direction; and a ventilation unit configured to perform ventilation between at least one of the developer conveying units whose internal pressure increases and at least one of the developer conveying units whose internal pressure decreases, wherein the ventilation unit includes a plurality of ventilation aperture paths through one or more barrier members between the plurality of developer conveying units, the ventilation aperture paths disposed remote from the plurality of developer apertures.

2. The developing device according to claim 1, further comprising:

a developer carrying body facing the image carrier, the developer carrying body being configured to carry the developer, wherein the plurality of developer conveying units includes:

a first developer conveying unit facing the developer carrying body, the first developer conveying unit being configured to supply the developer to the developer carrying body while conveying the developer in a lengthwise direction, a second developer conveying unit disposed at a position that is underneath the first developer conveying unit and that faces the developer carrying body, the second developer conveying unit being configured to convey, in the lengthwise direction, the developer that has separated from the developer carrying body, and a third developer conveying unit configured to convey the developer, which has been conveyed by the second developer conveying unit, to an upstream side of the first developer conveying unit and to convey the developer, which has reached a downstream side of the first developer conveying unit, to the upstream side of the first developer conveying unit.

3. The developing device according to claim 2, wherein the ventilation unit includes a first ventilation aperture path for communicating between the first developer conveying unit and the third developer conveying unit, and a second ventilation aperture path for communicating between the second developer conveying unit and the third developer conveying unit.

4. The developing device according to claim 3, wherein the first ventilation aperture path and the second ventilation aperture path are disposed at positions in the barrier members such that the ventilation aperture paths are not buried by the developer conveyed in the developing device.

5. The developing device according to claim 2, wherein the third developer conveying unit includes an internal pressure adjusting unit that is formed in such a manner that a first height from a developer surface of the developer to a top wall at an upstream side of the third developer conveying unit is lower than a second height from the developer surface of the developer to the top wall at a downstream side of the third developer conveying unit.

6. The developing device according to claim 5, wherein the second ventilation path includes an opening provided on a wall partitioning the second developer conveying unit and the third developer conveying unit, and the internal pressure adjusting unit is disposed at a downstream side with respect to the opening in a direction of conveying the developer in the third developer conveying unit.

7. The developing device according to claim 2, wherein the third developer conveying unit includes a ventilation hole for communicating with an outside of the developing device, and a filter configured to cover the ventilation hole.

8. The developing device according to claim 1, further comprising:

a supplying unit configured to supply new carriers to the developing device;

a discharge unit configured to discharge, to an outside, a part of the developer accommodated in the developing device; and a bypass path through which the part of the developer returns to an upstream side of the circulating paths without passing through a position where the discharge unit is disposed, wherein the bypass path is a part of the ventilation unit.

9. The developing device according to claim 8, wherein the supplying unit is configured to supply new toner with the new carriers to the developing device.

10. A process cartridge that is detachably attached to a main unit of an image forming apparatus, comprising:

the developing device according to claim 1; and the image carrier, wherein the developing device and the image carrier form a single unit.

11. An image forming apparatus, comprising:

the developing device according to claim 1; and the image carrier.

12. The developing device according to claim 1, wherein the plurality of developer conveying units includes first, second, and third developer conveying units, and wherein a portion of the ventilation unit is disposed in a substantially medial position in a lengthwise direction, the portion of the ventilation unit forming a pathway through a barrier member between the first and third developer conveying units.

13. The developing device according to claim 2, wherein the third developer conveying unit includes:

a screw auger; and a housing enclosing the screw auger, the housing having a base and an upper surface, wherein a first height of a first lengthwise interior portion of the housing between the base and the upper surface is substantially constant and approximates an outer diameter of the screw auger, and a second height of a second lengthwise interior portion of the housing between the base and the upper surface varies in magnitude along the second lengthwise interior portion of the housing.

14. The developing device according to claim 13, wherein the second height is sufficiently large to accommodate a ventilation aperture path through a barrier member between the first developer conveying unit and the third developer conveying unit, such that a surface level of developer conveyed by the screw auger in the third developer conveying unit remains lower than a bottom edge of the ventilation aperture path, thereby preventing developer from blocking the ventilation aperture path from a side of the third developer conveying unit and preserving an air flow path.

* * * * *